United States Patent [19]

Weller

[11] Patent Number: 4,875,814

[45] Date of Patent: Oct. 24, 1989

[54] INTERMODAL CAGED FLATBED FOR EFFICIENT CONTAINERIZED CARGO HANDLING

[76] Inventor: Raymond N. Weller, 1421 Waylon Ave., Norfolk, Va. 23509

[21] Appl. No.: 134,984

[22] Filed: Dec. 18, 1987

[51] Int. Cl.[4] ..... B60P 1/00; B60P 7/13

[52] U.S. Cl. ..... 410/66; 410/3; 410/7; 410/77; 410/94; 410/121; 410/128; 410/143; 220/1.5

[58] Field of Search ..... 410/66, 2, 3, 52, 77, 410/94, 93, 121, 127, 128, 143, 144–152, 122, 131, 7, 8, 18; 411/21, 22, 344, 345, 341, 55; 403/297; 220/1.5

[56] References Cited

U.S. PATENT DOCUMENTS

| | | | |
|---|---|---|---|
| 773,126 | 10/1904 | Cottman | 410/66 |
| 1,793,806 | 2/1931 | Kellett | 410/52 |
| 2,716,872 | 9/1955 | Test | 410/66 |
| 3,219,152 | 11/1965 | Castellani et al. | 410/66 |
| 3,667,635 | 6/1972 | Hackney | 410/66 |
| 3,784,054 | 1/1974 | Mautz | 410/77 |
| 4,052,083 | 10/1977 | Lutz | 410/144 |

FOREIGN PATENT DOCUMENTS

| | | | |
|---|---|---|---|
| 62676 | 6/1955 | France | 410/52 |

*Primary Examiner*—Andres Kashnikow
*Assistant Examiner*—Mark T. Le
*Attorney, Agent, or Firm*—Low and Low

[57] ABSTRACT

An intermodal caged flatbed for use with large sea and land freight containers which snugly fit within such containers, preferably in end-to-end relation and wherein full length doors are provided on either side thereof for quick access for load/unload operations and rollable members facilitate positioning and use. In so doing, turnaround time and labor costs in loading and unloading freight containers are held to a minimum while efficient cargo handling is provided.

13 Claims, 2 Drawing Sheets

INTERMODAL CAGED FLATBED FOR EFFICIENT CONTAINERIZED CARGO HANDLING

BACKGROUND OF THE INVENTION

In the shipping and cargo handling trade, it is vital to maximize expeditious handling of cargo loads, especially relatively small cargo, so as to maximize loading, unloading, and turnaround of a ship, tractor trailer, or other transport mode, and thereby enhance efficiency while seeking to minimize costs, damage, loss, and the like.

Illustrative activity directed toward improvements in freight handling of this nature is found extending over numerous years of development in numerous U.S. Pat. Nos. 3,620,391 to Fujioka, Fitch 1,613,387, Moreau 1,994,399, Coppinger 1,932,955, Andrews 1,522,707, or LeDuc 4,306,830, for example.

Major strides have been accomplished in this regard by the widespread adoption and use of so-called "containerized" freight in vehicular and waterborne transport. Quite generally at the present time, cargo holds on shipboard as well as vehicular trailers and their associated handling equipment have been adapted for ready use of such containers, which are of substantial dimensions. Illustratively, such a sea container may be on the order of a generally standardized 40 or 20 feet in length, and 8 feet in height and width, but may also partake of somewhat varying dimensions in particular applications, as shown for example in the "Container Specification 1987" booklet of the West German Hapag-Lloyd shipping and transport line. Like container equipment is available and in use with virtually all other cargo concerns.

While such containers achieve all that is desired in the safe and expeditious handling of the once-loaded or unloaded large sea or road containers, the same do not address the problem of ready packing or stuffing of the cargo or shipment within the large sea or road containers, or unloading and stripping therefrom.

Such contents handling, whether by pallet load, diverse forklift transfer or other shipment handling into and from the freight container itself remains frequently a piecemeal and time-consuming operation.

There exists a need and demand for improved handling of the cargo within the sea or road container so as to place the large containers into service promptly for transfer to ship or trailer and in like manner to expedite the emptying thereof so that the empty container can be rapidly transferred to a location elsewhere for reloading, and thereby avoid excessive "downtime" during tedious load/unload operations.

Concomitantly therewith, any effort to enhance in-container cargo handling must also preclude the likelihood of unwanted damage, as well as reasonable adaptability to the diverse dimensions of in-container cargo.

BRIEF SUMMARY OF THE INVENTION

The foregoing objects are well achieved by the invention herein which uniquely comprises a caged flatbed structure dimensioned to fit within the primary shipping container, and preferably so dimensioned that one or two such caged flatbeds may be received therein end-to-end and occupy substantially the full width and height of the sea or road container.

The shipment therein, which may comprise a few or a multiplicity of individual units, may be readily separately loaded into the caged flatbed while the container proper to receive the flatbed units may be being unloaded from a previous shipment, or may be enroute to the flatbed load location, thereby enhancing time efficiency.

In similar manner, unloading the large 40' or like shipping container is quickly effected by removal from therewithin of the one or two caged flatbeds as individual units, and in so doing, all cargo irrespective of the number of discrete shipment units thereof is expeditiously removed from the container, which can then be reloaded or transported to a location elsewhere for use.

Further, to facilitate loading and unloading of the caged flatbed of the invention, the same is preferably provided with floor-engaging rollers or casters, or, depending upon dimensions or loads, may be readily handled by a forklift vehicle, or inserted subjacent conveyor means, or by other devices known in the art.

In like manner the caged flatbed itself is readily loaded and unloaded, wherein the same is provided with substantially full-width multiple side doors on both sides thereof to permit ready access by personnel or handling equipment. In this regard, the caged flatbed may be open at the top, as in use the top of the surrounding container forms the upper restricting barrier, while the perimetrical cage is preferably open mesh fencing or apertured light gauge metal to minimize weight while also providing easy visibility of the caged contents. The top may be covered by mesh or sheeting if desired to reduce easy pilferage therefrom.

Additionally, the caged flatbed embraces the external use of shiftable pressure means to clamp or secure the flatbeds within the container proper therein in those cases in which the container is so sized that the flatbed does not utilize the full width thereof or if the container has no readily useable clamp means.

BRIEF DESCRIPTION OF THE DRAWINGS

The invention will be better understood in connection with the accompanying drawings, in which.

DESCRIPTION OF THE PREFERRED EMBODIMENT

Figure 1:
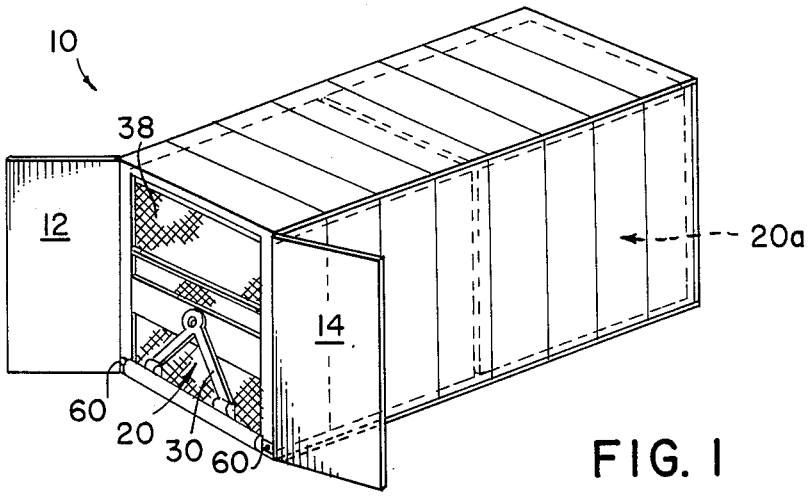
FIG. 1 is an overall perspective view of a typical shipping container having a caged flatbed seen therein through open doors.

Referring to the drawings, there is shown in FIG. 1 a typical large shipping container 10 commonly employed for international or other large shipments of containerized cargo. As indicated, such containers 10 are not uncommonly 40 feet in length and are fully enclosed by metal side, top and-bottom panels, appropriately reinforced as by ribbing or other means well known in the art.

Such containers may be of varying dimension depending upon the particular manufacturer or user thereof in its business, and may be open-topped, stake bodied, or have other well known forms, although the most common is an enclosed cube or like form for maximized enclosed capacity.

The same are commonly provided with end doors 12, 14 appropriately hinged to the container and having usual latching, locking, and securing means. Upon opening doors 12, 14, cargo may be placed into and removed from the container 10.

In accordance with the invention, one or more caged flatbeds 20 receiving the freight cargo may be disposed within the container 10. As seen through the open doors, 12, 14, an end of a first such flatbed 20 is visible therein, and as indicated in dashed lined, the container 10 may be of such length, as 40 feet, as to receive a second flatbed 20*a* therein in end-to-end relation with flatbed 20, and so fully fill the container 10.

Figure 2:
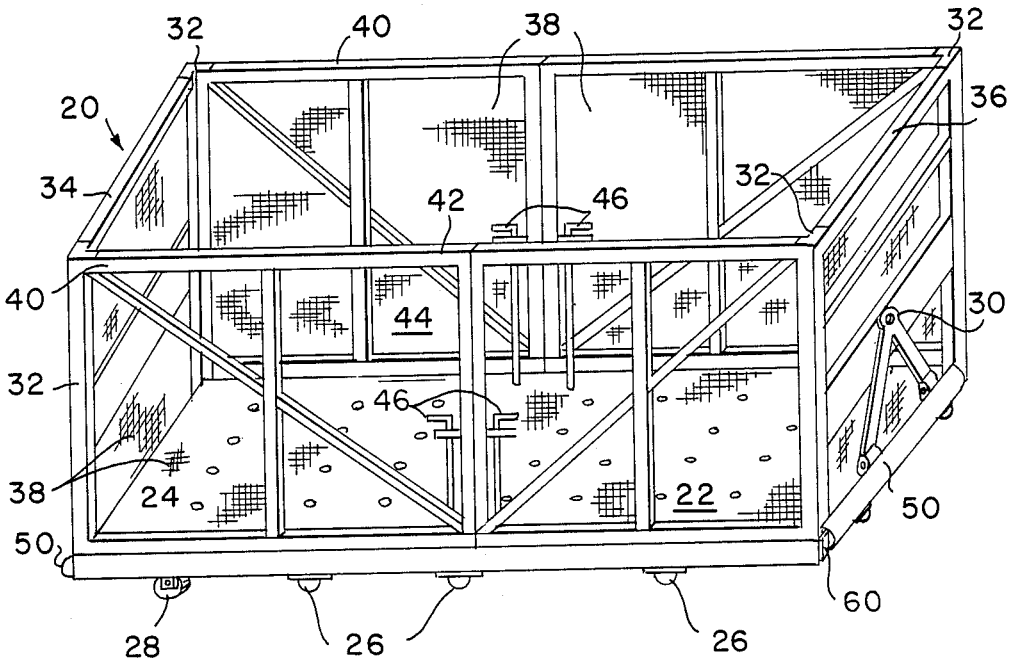
FIG. 2 is a general perspective view of a caged flatbed in accordance with the invention.

The flatbed 20 may partake of various forms and features in achieving the objects of the invention. One basic form thereof is shown in more detail in FIG. 2 which well provides the high speed handling and turnaround of the large containers 10 as well as expeditious handling of the goods therein.

Thus the flatbed 20 preferably includes a base or floor 22 of appropriately reinforced metal or other material for the loads expected, and wherein the floor 22 is likewise preferably apertured as at 24 to permit free ventilation and air circulation through and around the flatbed and its contained cargo.

On the underside of floor 22 are provided a plurality of casters or rollers 26, 28. The arrangement and number thereof is a function of the size of the flat bed so that the load-carrying ability of the rollers will be sufficient for the use intended. In order to facilitate movement of the flatbed 20, the major portion of the floor undersurface is provided with rollers 26 in a series of transverse rows, four such rows being shown. The rollers 26 have universal rolling or castering ability so as to permit shifting of the flatbed in any direction, while at just one end of flatbed 20, preferably at the rear, a transverse series of single axis rollers 28 is provided.

In this manner, the rollers 28 will tend to facilitate linear movement of the flatbed 20 into and from the container 10, while the universal rollers will aid ready reorientation or repositioning of the flatbed in a warehouse or other storage area for load/unload operations or suitable relocation of the flatbed proper. While five rows of roller supports are shown which well support and distribute any load thereon, obviously a differing number of roller supports and arrangements may be provided as may be desirable.

As indicated, a tow means as a hinged towbar and eye 30 are mounted at the end of flatbed 20 which may be swung down from stored upright position to permit ready withdrawal of the flatbed 20 from container 10 as well as insertion thereinto and manipulation of the flatbed in a freight handling area during loading or unloading.

The flatbed includes a plurality of corner standards 32 fixed thereto and between which at the ends of the flatbed suitable lightweight framing 34, 36 extends to receive and support walls of perforated or expanded metal, or wire mesh screening as at 38, for example. The longer sides of the flatbed preferably include top framing as at 35 and a central transverse brace at 37. The brace 37 is preferably readily manually removable and replaceable by reception of its ends in suitable brackets on the top frame member 35, as at 35*a* in FIG. 5, for example. Removal of the transverse brace facilitates easy top loading of the flatbed, and may then be replaced to rigidify the flatbed.

The longer sides of the flatbed are uniquely provided with full-length doors 40, 40 on both sides thereof defined by suitable framing 42 and similarly provided with expanded metal or wire mesh screening at 44. The doors are respectively hinged to the standards 32 and provided at their meeting edges centrally of the flatbed with usual latch and lock means illustratively shown at 46. Similarly, pivoted support legs 49 are preferably provided at the opening edge of each door, so that when the doors are swung away from the flatbed to open position as seen in FIG. 3, for example, the legs 49 may be swung down to engage the floor surface and aid in supporting the weight of the door.

Figure 5:
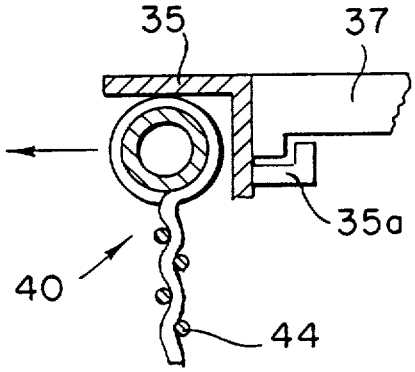
FIG. 5 is a fragmentary side sectional elevation of one means of associating the top framing of the flatbed and the frame of the adjacent door; and, FIG. 6 is a fragmentary elevation of one form of associating the flatbed frame with the hinged doors.
Figure 6:
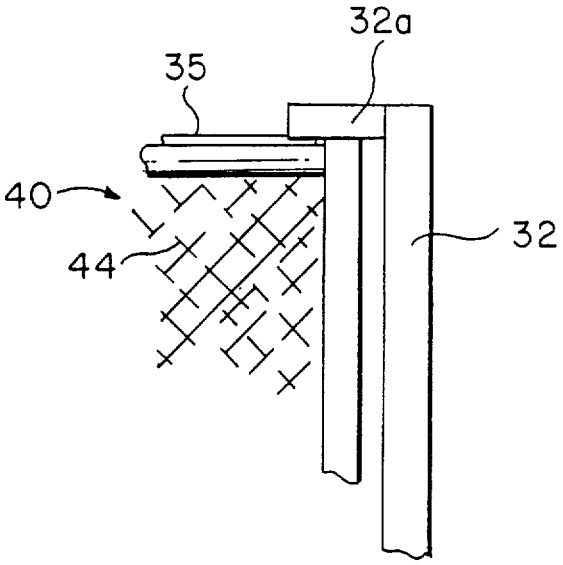

While many structural arrangements of the flatbed framing and door are possible and would be suitable within the concept of the invention, FIGS. 5 and 6 illustrate in more detail the door and adjacent flatbed framing. Thus, in FIG. 6 each corner standard 32 may include hinge flanges 32*a* with which the vertical standards of the doors 40 are pivotally associated at the top and bottom of the standards 32. Further, the top longitudinal framing 35 extending between and secured to the standards 32 may be an angle iron as seen in FIG. 5, whereby the top frame of door 40 may abut the depending flange of framing 35 on closing the door while yet readily swing outwardly as indicated by the arrow. The mesh or like wire screening 44 of the doors may wrap around the framing as indicated in FIG. 5, or be secured thereto in various manners known in the art for screening, fencing, and the like.

Figure 3:
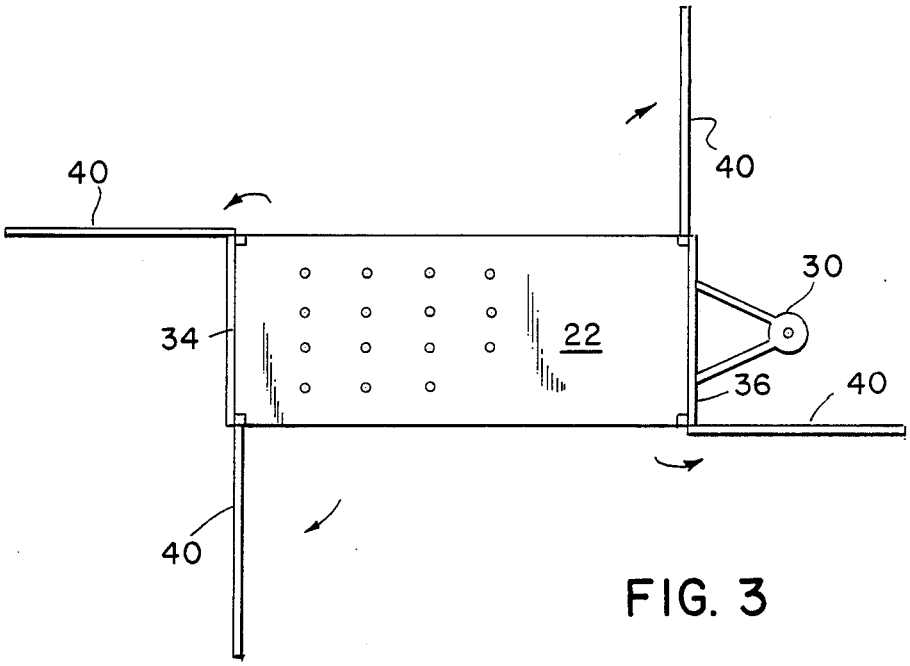
FIG. 3 is a diagrammatic top plan thereof illustrating the open access thereto for loading and unloading.

Thus, as indicated in FIG. 3, each of the doors 40 may be individually fully opened to provide full-length access to the flatbed 20 for total facility and ease in loading the flatbed whether by forklift truck means, hand dollies, or manually as may be requisite. While as shown, on each side of the flatbed, one door may swing open a full 180° and the other just 90° which will provide open and unobstructed approach to the flatbed floor, if desired all doors may be hinged to swing through the full 180° if desired to permit approach of load/unload equipment.

Bumper means 50 at either end of flatbed 20 are provided to cushion impact one against the other when loaded inside container 10, or in general during handling in a warehouse or at a dock. Further, number plates or optically encoded data plates 51 are suitably located on the framing on one or more sides thereof for appropriate tracking of the flatbeds or their cargo. If desired, the same may be rough surfaced or matte black so as to permit quick chalking of identifying data thereon.

To insure snug fit of the flatbeds 20 of the invention within containers 10 within necessary tolerances of size and manufacture, as well as to insure adequate clearance between the flatbed and the container for insertion and extraction, an elongated pressure locking panel 60 is preferably employed. One such panel 60 is provided on each side of the flatbed 20. Upon placement of the flatbed within the container 10, each panel 60 is disposed between the flatbed floor 22 and an inside wall of the container 10, as generally seen in FIG. 1.

Figure 4:
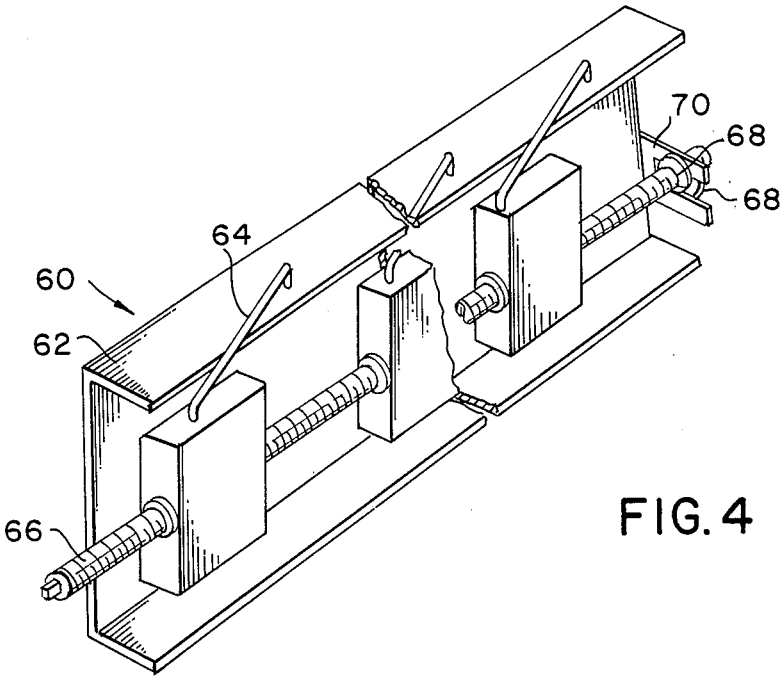
FIG. 4 is a perspective view of the elongated locking panel useable in conjunction therewith.

While the pressure or clamping means 60 may partake of varying forms, as seen illustratively in FIG. 4 the same may embrace an elongated member as a channel 62 having a plurality of pressure blocks 63 mounted thereadjacent by means of U-shaped swing arms 64. The blocks 63 may be fixedly secured to the flatbed. Each end of an arm 64 is pivotally mounted within a flange of channel 62 and also at blocks 63, while the several blocks 62 are provided with aligned threaded bores through which is received a screw 66 which is confined against axial movement with respect to channel 60 at one end by virtue of fixed collars 68 on either side of slotted member 70 secured to the channel.

The forward end of screw 66 is shaped to receive a crank or wrench, whereby upon turning of the screw, the channel 62 will be constrained to move toward or away from the blocks. Accordingly, the flatbed 20 may be clamped within the container 10 to be fixed with respect thereto upon expanding movement of the locking means 60 disposed between the flatbed and the container wall, with the flat face of the channel preferably butted against the inside wall of container 10. Obviously, other expanding and locking means may be employed using other parallelogram or like means. The provision thereof enhances intermodal use of the flatbed in that the same may adapt for slightly varying size containers that may be employed by differing shipping or freight lines, whereby only a limited number of size variations need be provided for the flatbed structure, thereby minimizing costs and storage requirements.

It will be seen, then, that in use, a container 10 having one or two caged flatbeds 20, 20*a* therein may be delivered to a loading dock or other freight facility, whereat the container doors 12, 14 are opened. Thereupon, the caged flatbed therein clamped by pressure means 60 is released by appropriately cranking screws 66 on either side of the flatbed.

The now freed flatbed 20 is withdrawn after lowering the towbar 30 and taken to an unload point in the warehouse, after which the several doors 42 are opened as requisite.

It will be seen that the entire large container 10 is emptied in just two steps (if two flatbeds are therein), and the container is immediately ready for reload or relocation. This compares as above noted with time-consuming repetitive unloading steps whether by fork-lift or by other means hithero required for loaded sea or road containers of this type.

The reload is obviously accomplished in reverse manner, with the flatbed or flatbeds backed into the container by the towbar, wherein the fixed axis rollers 28 facilitate the insertion. After snug bumpering of two flatbeds, for example, and respective expanding of the locking panels 60, the container doors are closed and the quick-loaded shipment is then taken to its shipping point.

While I have described a preferred embodiment of my invention, variants thereof may be employed within the spirit and scope thereof as defined within the appended claims.

I claim:

1. An intermodal caged flatbed for cargo handling in cooperative association with any conventional box-like freight shipping container comprising, a floor for receiving and supporting cargo and having a front, rear, and opposite sides, a perimetrical cage, said cage including apertured panels around said floor, and having door means extending the full length of a said side, said floor and cage having overall external dimensions defining a size generally closely receivable in height and width within a said freight shipping container, expandable pressure means mounted on at least two opposing longitudinally extending sides of said cage flatbed for securing said flatbed within a said container irrespective of slightly varying internal dimensions of any particular said container within which said flatbed is received, and means for expanding each said pressure means between and into engagement with a respective external side of said caged flatbed and a respective adjacent internal wall of a said container to firmly position one with respect to the other.

2. The intermodal caged flatbed of claim 1 further including door means extending the full length of the other said side.

3. The intermodal caged flatbed of claim 1 further including rollable support means for said floor.

4. The intermodal caged flatbed of claim 3 wherein said rollable means includes a plurality of multi-axis rollers and a plurality of single axis rollers, said single-axis rollers being disposed at one end of said floor.

5. The intermodal caged flatbed of claim 1 wherein the length dimension of said flatbed is substantially one-half of the internal length dimension of a said container, thereby to permit insertion of two said flatbeds end-to-end in a said container.

6. The intermodal caged flatbed of claim 1 further including towbar means on one end thereof.

7. The intermodal caged flatbed of claim 1 further including ventilation means in said floor.

8. The intermodal caged flatbed of claim 9 wherein the length dimension of said flatbed is substantially one-half of the internal length dimension of a said container, thereby to permit insertion of two said flatbeds end-to-end in a said container.

9. The intermodal caged flatbed of claim 8 further including door means extending the full length of the other said side.

10. The intermodal caged flatbed of claim 1 wherein said pressure means includes screw-actuated expandable parallelogram members, with one said member adjacent said floor and the other said member on the outside thereof for engagement with a said container.

11. A method of handling large freight containers by use of intermodal caged flatbeds comprising the steps of:

providing a flatbed having a floor and a surrounding cage-like wall having full length doors therealong, and whose height and width dimensions are slightly less than the interior like dimensions of a said freight container, providing said flatbed with expandable pressure means carried thereby along a length dimension on each of two opposite sides of said flatbed to secure said flatbed within containers of slightly varying internal dimensions, opening said doors and loading freight onto said floor, closing said doors and loading said flatbed into said container and, expanding the several pressure means on the flatbed to fix the flatbed within the container for transport without modifying said container.

12. The method of claim 1 including the further steps of removing said flatbed from said container to free said container for reuse, opening the doors thereof, and removing the freight from said flatbed.

13. The method of claim 11 including the further steps of providing a said flatbed with a length dimension substantially equal to one-half of the interior length of said container, and, inserting two said flatbeds into said container in end-to-end relation.

* * * * *

UNITED STATES PATENT AND TRADEMARK OFFICE

CERTIFICATE OF CORRECTION

PATENT NO. : 4,875,814

DATED : October 24, 1989

INVENTOR(S) : RAYMOND N. WELLER and HARRY M. L. WALTON III

It is certified that error appears in the above-identified patent and that said Letters Patent is hereby corrected as shown below:

On the front page, the caption "Inventor" should read:

Raymond N. Weller, 1421 Waylon Avenue, Norfolk, Va. 23509 and Harry M. L. Walton III, 133 Dover Circle, Norfolk, Va., 23505

In the drawings, Sheet three, containing FIGURES 5 and 6 are added and included with Sheets 1 and 2 containing Figs. 1-4

Signed and Sealed this

Eleventh Day of December, 1990

*Attest:*

*Attesting Officer*

HARRY F. MANBECK, JR.

*Commissioner of Patents and Trademarks*